US009312079B2

(12) United States Patent
Chang et al.

(10) Patent No.: US 9,312,079 B2
(45) Date of Patent: Apr. 12, 2016

(54) KEYSWITCH AND KEYBOARD THEREWITH

(71) Applicants: DARFON ELECTRONICS (SUZHOU) CO., LTD., Suzhou, Jiangsu Province (CN); DARFON ELECTRONICS CORP., Taoyuan (TW)

(72) Inventors: Chao-Lung Chang, Taoyuan (TW); Liang-Ta Yeh, Taoyuan (TW)

(73) Assignees: DARFON ELECTRONICS (SUZHOU) CO., LTD., New District, Suzhou, Jiangsu Province; DARFON ELECTRONICS CORP., Gueishan, Taoyuan (TW)

( * ) Notice: Subject to any disclaimer, the term of this patent is extended or adjusted under 35 U.S.C. 154(b) by 229 days.

(21) Appl. No.: 14/263,986

(22) Filed: Apr. 28, 2014

(65) Prior Publication Data

US 2014/0339064 A1 Nov. 20, 2014

(30) Foreign Application Priority Data

May 16, 2013 (TW) ..... 102209173 U

(51) Int. Cl.

| | |
|---|---|
| ***H01H 9/26*** | (2006.01) |
| ***H01H 13/72*** | (2006.01) |
| ***H01H 3/12*** | (2006.01) |
| ***H01H 13/7065*** | (2006.01) |

(52) U.S. Cl.
CPC ..... *H01H 3/125* (2013.01); *H01H 13/7065* (2013.01); *H01H 2215/006* (2013.01); *H01H 2221/058* (2013.01)

(58) Field of Classification Search
CPC ..... H01H 3/125; H01H 13/7065; H01H 2221/058; H01H 13/12; H01H 23/02; H01H 13/705; H01H 13/76
USPC ..... 200/5 A, 344, 345
See application file for complete search history.

(56) References Cited

U.S. PATENT DOCUMENTS

| | | | | |
|---|---|---|---|---|
| 5,823,325 | A * | 10/1998 | Lin | H01H 3/125 200/344 |
| 6,020,566 | A * | 2/2000 | Tsai | H01H 3/122 200/344 |
| 6,618,239 | B2 * | 9/2003 | Takahashi | H01H 3/125 200/344 |
| 7,199,320 | B2 * | 4/2007 | Sato | H01H 13/7065 200/341 |
| 8,410,385 | B2 * | 4/2013 | Dai | H01H 13/12 200/296 |
| 2002/0185364 | A1 | 12/2002 | Takahashi | |
| 2011/0226600 | A1 * | 9/2011 | Lo | H01H 3/122 200/5 A |

FOREIGN PATENT DOCUMENTS

| | | |
|---|---|---|
| TW | 408827 | 10/2000 |
| TW | 424923 | 3/2001 |
| TW | M400024 U1 | 3/2011 |

* cited by examiner

*Primary Examiner* — Kyung Lee
(74) *Attorney, Agent, or Firm* — Winston Hsu; Scott Margo

(57) ABSTRACT

A key switch disposed on a base of a keyboard includes a key cap, a linkage bar, an edge plate and a recess portion. The key cap is disposed above the base. The linkage bar connects the key cap and the base. The edge plate is connected to the base. A slot is formed on the edge plate, and an end of the linkage bar is slidably latched in the slot. The recess portion is formed on the base and adjacent to the slot. A step is between a holding surface of the recess portion and a top surface of the base. The end of the linkage bar is caved in the recess portion and held on the holding surface of the recess portion when the end of the linkage bar is slidably latched in the slot.

20 Claims, 7 Drawing Sheets

KEYSWITCH AND KEYBOARD THEREWITH

BACKGROUND OF THE INVENTION

1. Field of the Invention

The present invention relates to a key switch and a keyboard therewith, and more particularly, to a thin key switch and a keyboard therewith.

2. Description of the Prior Art

With development of personal computer industry, a keyboard has been one of the input instruments for inputting words, symbols, numerals and so on. Recently, most electronic devices have light-thin designs, leading the keyboard implemented in the electronic device to be developing toward a trend with thin in size. However, lots of mechanisms, such as plunger, rubber dome, linkage bar and so on, are disposed inside the keyboard, which occupies a specific internal volume of a key switch of the keyboard. Accordingly, it constrains height of the key switch and disadvantages in designs of the key switch and the keyboard toward the trend with thin in size. Thus, design of the key switch and keyboard with thin in size has become an issue in the industry.

SUMMARY OF THE INVENTION

The present invention provides a thin key switch and a keyboard therewith for solving above drawbacks.

According to an embodiment of the present invention, a key switch disposed on a base of a keyboard includes a key cap, a linkage bar, an edge plate and a recess portion. The key cap is disposed above the base. The linkage bar connects the key cap and the base. The edge plate is connected to the base. A slot is formed on the edge plate, and an end of the linkage bar is slidably latched in the slot. The recess portion is formed on the base and adjacent to the slot. A step is formed between a holding surface of the recess portion and a top surface of the base. The end of the linkage bar is caved in the recess portion and held on the holding surface of the recess portion when the end of the linkage bar is slidably latched in the slot.

In summary, the holding portion formed on the base and the step between the holding surface of the holding portion and the top surface of the base of the present invention allow the end of the linkage bar to be caved in the holding portion when the end of the linkage bar is assembled to the edge plate, leading to that the linkage bar approaches the base by the distance of about the step. Furthermore, since the linkage bar is connected to the key cap, the key cap is activated by the linkage bar to approach the base by the distance of about the step. In such a manner, overall height of the key switch decreases, and thus it advantages in designs of the key switch and the keyboard toward the trend with thin in size.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the embodiments, reference is made to the accompanying drawings which form a part hereof, and in which is shown by way of illustration specific embodiments in which the invention may be practiced. In this regard, directional terminology, such as "top," "bottom," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," and "installed" and variations thereof herein are used broadly and encompass direct and indirect connections and installations. Accordingly, the drawings and descriptions will be regarded as illustrative in nature and not as restrictive.

Figure 1:
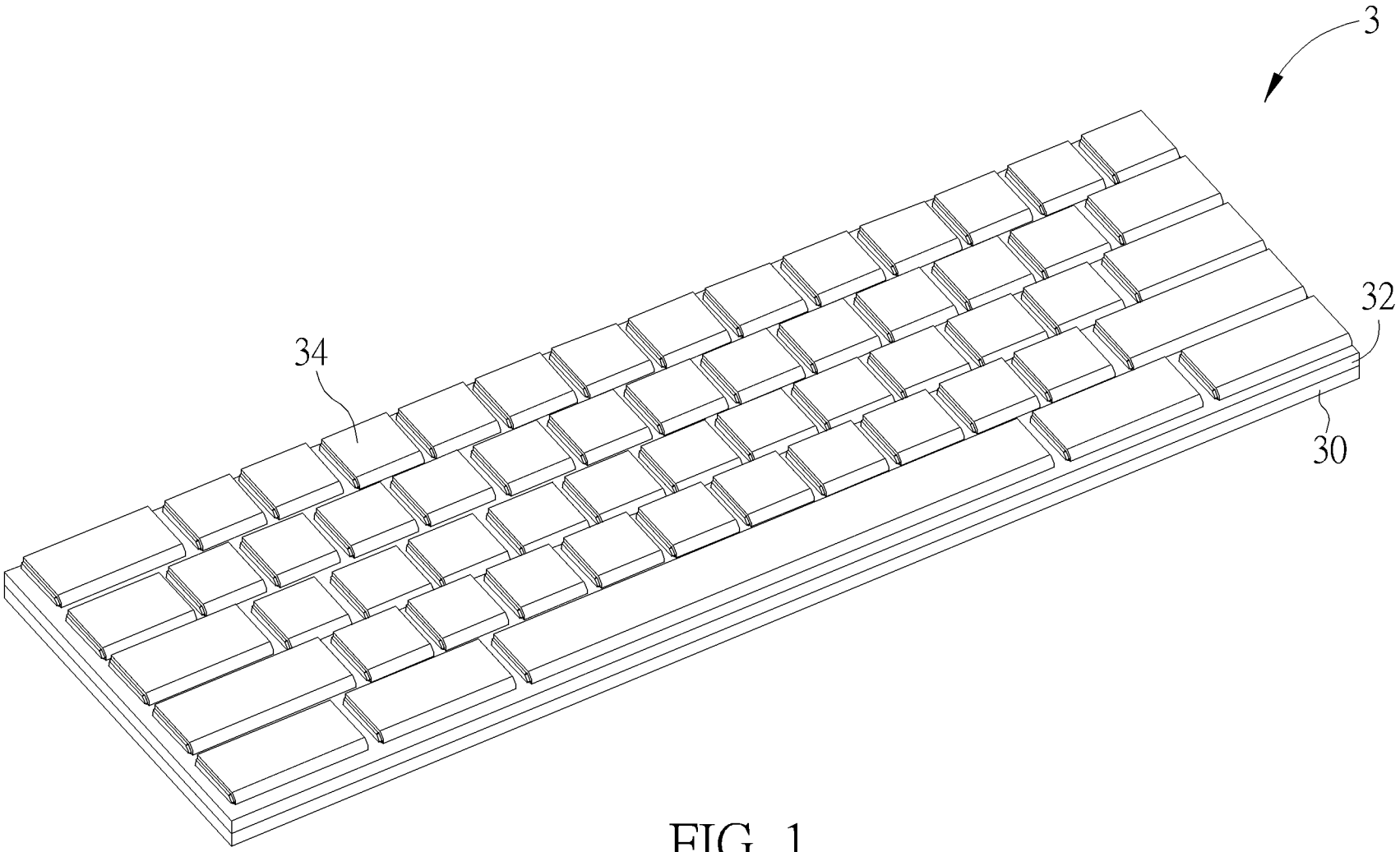
FIG. 1 is a diagram of a keyboard according to an embodiment of the present invention.

Please refer to FIG. 1. FIG. 1 is a diagram of a keyboard 3 according to an embodiment of the present invention. As shown in FIG. 1, the keyboard 3 includes a base 30, a circuit board 32 and a plurality of key switches 34. The circuit board 32 and the plurality of key switches 34 are disposed on the base 30, and the plurality of key switches 34 are provided for a user to press, so as to activate the circuit board 32 for performing desired operations, such as inputting words, symbols, numerals and so on.

Figure 2:
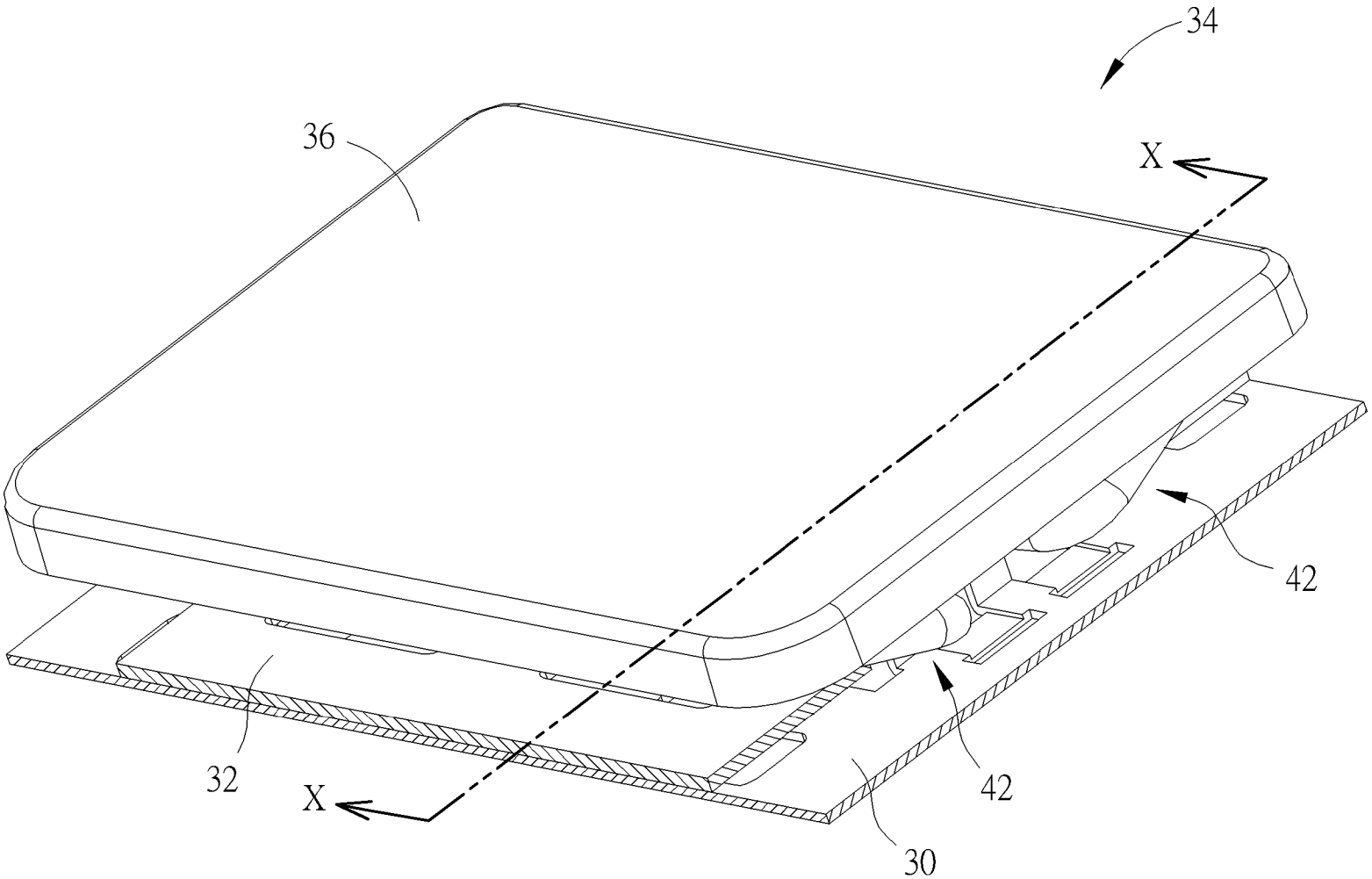
FIG. 2 is a partly diagram of a key switch according to the embodiment of the present invention.
Figure 3:
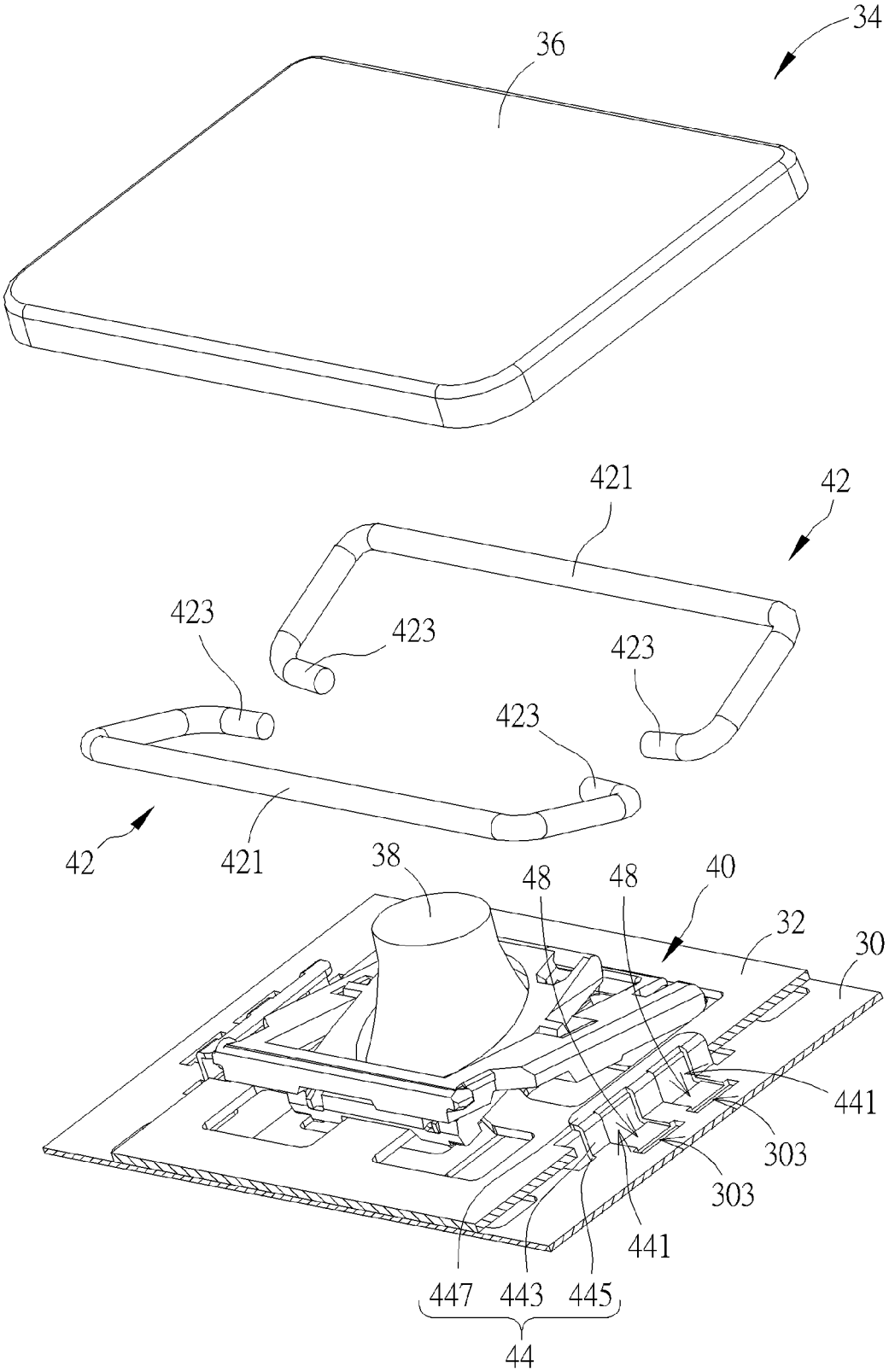
FIG. 3 is a partly exploded diagram of the key switch according to the embodiment of the present invention.
Figure 4:
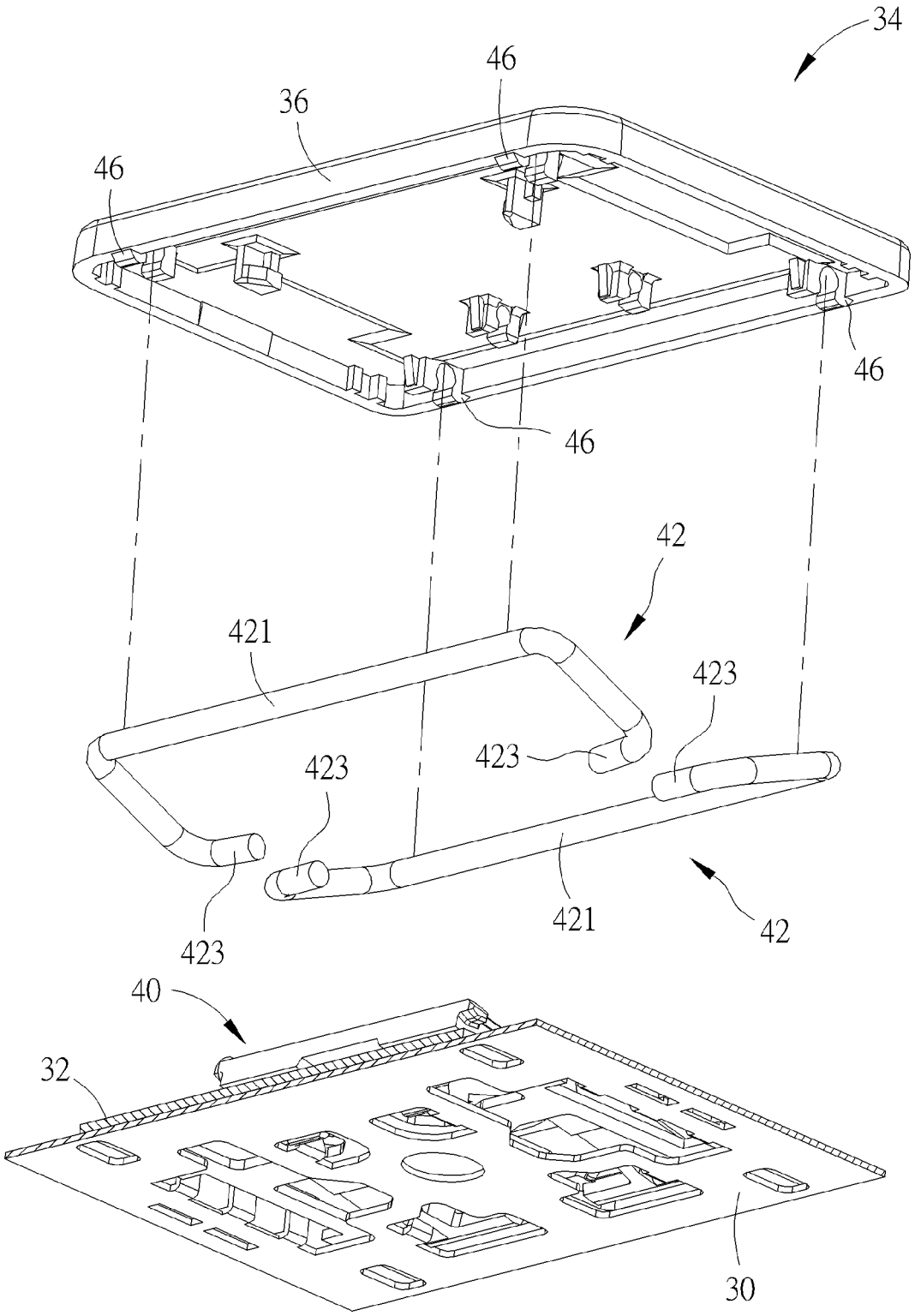
FIG. 4 is a partly exploded diagram of the key switch in another view according to the embodiment of the present invention.
Figure 5:
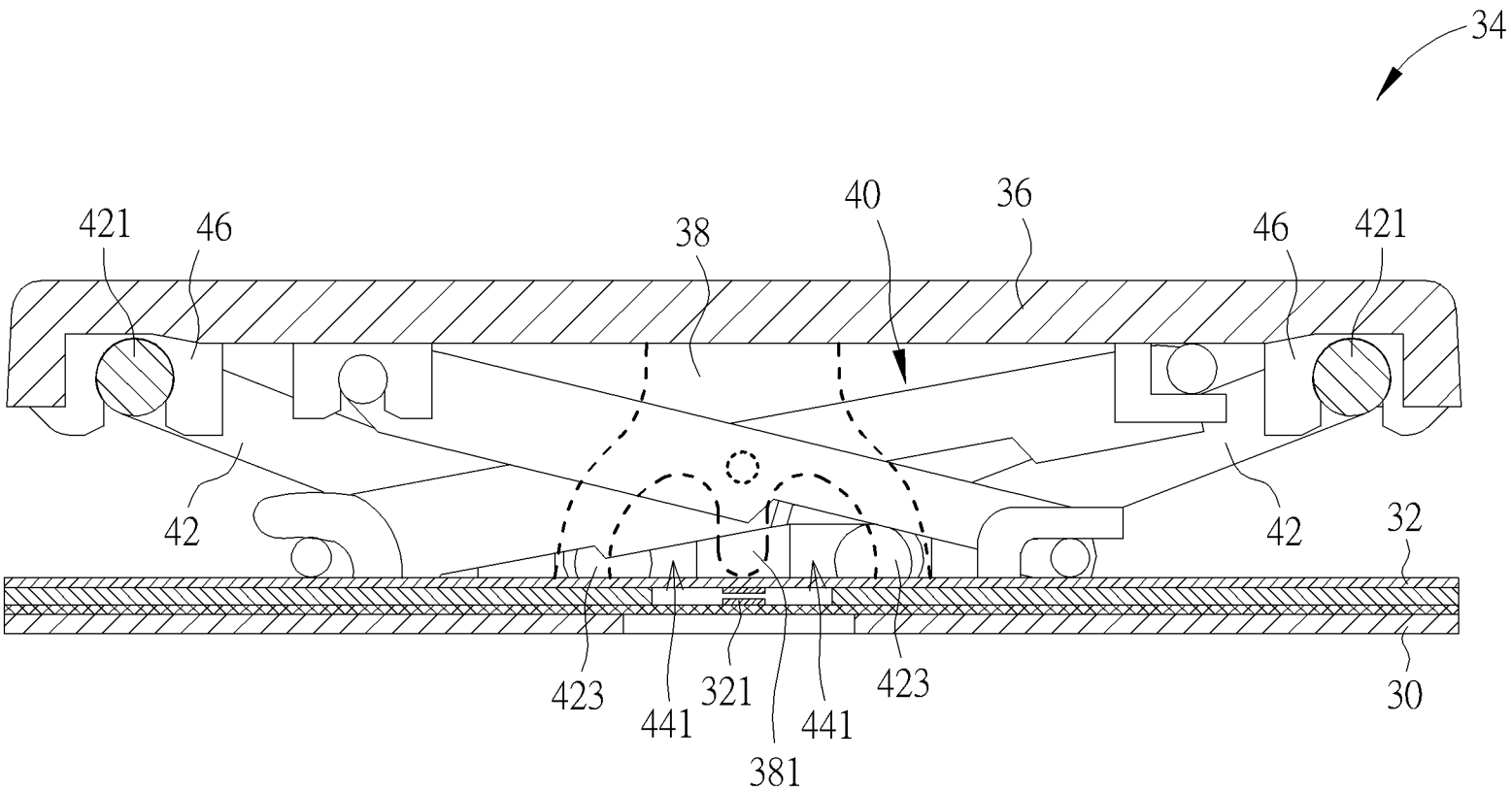
FIG. 5 is a sectional diagram of the key switch along line X-X in FIG. 2.

Please refer to FIG. 2 to FIG. 5. FIG. 2 is a partly diagram of the key switch 34 according to the embodiment of the present invention. FIG. 3 is a partly exploded diagram of the key switch 34 according to the embodiment of the present invention. FIG. 4 is a partly exploded diagram of the key switch 34 in another view according to the embodiment of the present invention. FIG. 5 is a sectional diagram of the key switch 34 along line X-X in FIG. 2. As shown in FIG. 2 to FIG. 5, the key switch 34 includes a key cap 36 and a resilient member 38. The key cap 36 is disposed above the base 30, and the resilient member 38 is disposed between the base 30 and the key cap 36. When the key cap 36 is pressed, the key cap 36 moves toward the base 30 and compresses the resilient member 38. Meanwhile, the resilient member 38 deforms elastically and stores a potential energy. When the key cap 36 is released, the resilient member 38 releases the potential energy and applies the key cap 36 with a resilient force, so as to recover the key cap 36.

In this embodiment, the resilient member 38 can be a rubber dome, but the present invention is not limited thereto. For example, the resilient member 38 can be a metal spring as well. As for which one of the above-mentioned designs is adopted, it depends on practical demands. Furthermore, the circuit board 32 includes a switch 321 corresponding to each of the key switches 34, and the resilient member 38 has an activating portion 381 located in a position corresponding to the switch 321. When the key switch 34 is pressed, the resilient member 38 is compressed, such that the activating portion 381 of the resilient member 38 presses the switch 321 of the key switch 34, so as to perform a switch instruction, such as inputting words, symbols, numerals and so on. In this embodiment, the circuit board 32 can be a membrane, but the present invention is not limited there to. For example, the circuit board 32 can be a circuit board with switches as well. As for which one of the above-mentioned designs is adopted, it depends on practical demands.

Furthermore, the key switch 34 includes a lift support mechanism 40 disposed between the base 30 and the key cap 36. When the key switch 34 is pressed, the lift support mechanism 40 can evenly distribute the pressing force to the key cap 36, such that the key cap 36 moves toward the base 30 stably for activating the switch 321 and performing the switch instruction. When the keycap 36 is released and recovered, the lift support mechanism 40 can evenly distribute the resilient force applied by the resilient member 38 to the key cap 36, such that the key cap 36 moves away from the base 30 stably. In other words, the lift support mechanism 40 is used for activating the key cap 36 to move toward or away from the base 30, so as to stabilize the key cap 36 to approach or depart from the base 30 and facilitate stability of movement of the key switch 34.

Figure 6:
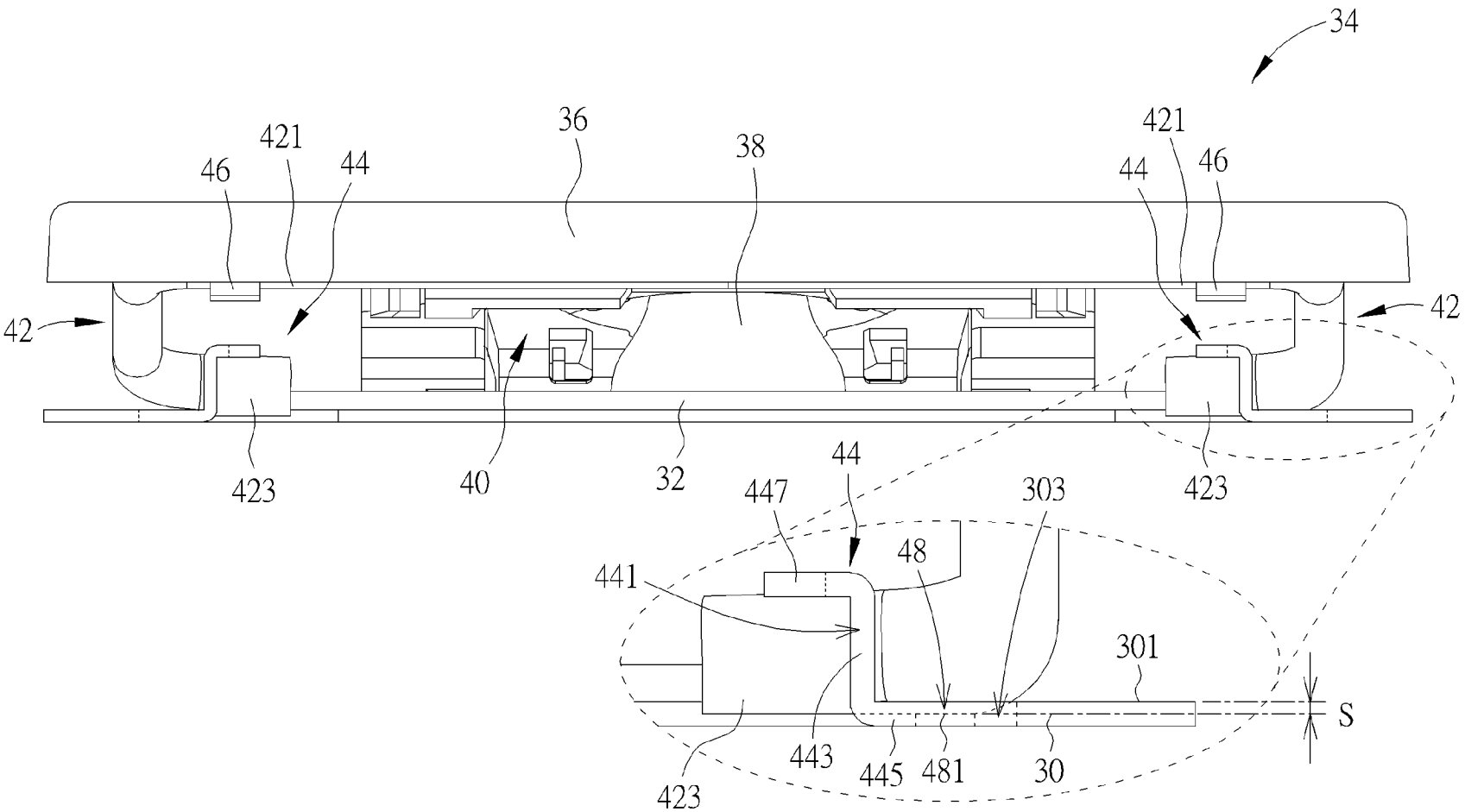
FIG. 6 is a diagram of the key switch in another view according to the embodiment of the present invention.
Figure 7:
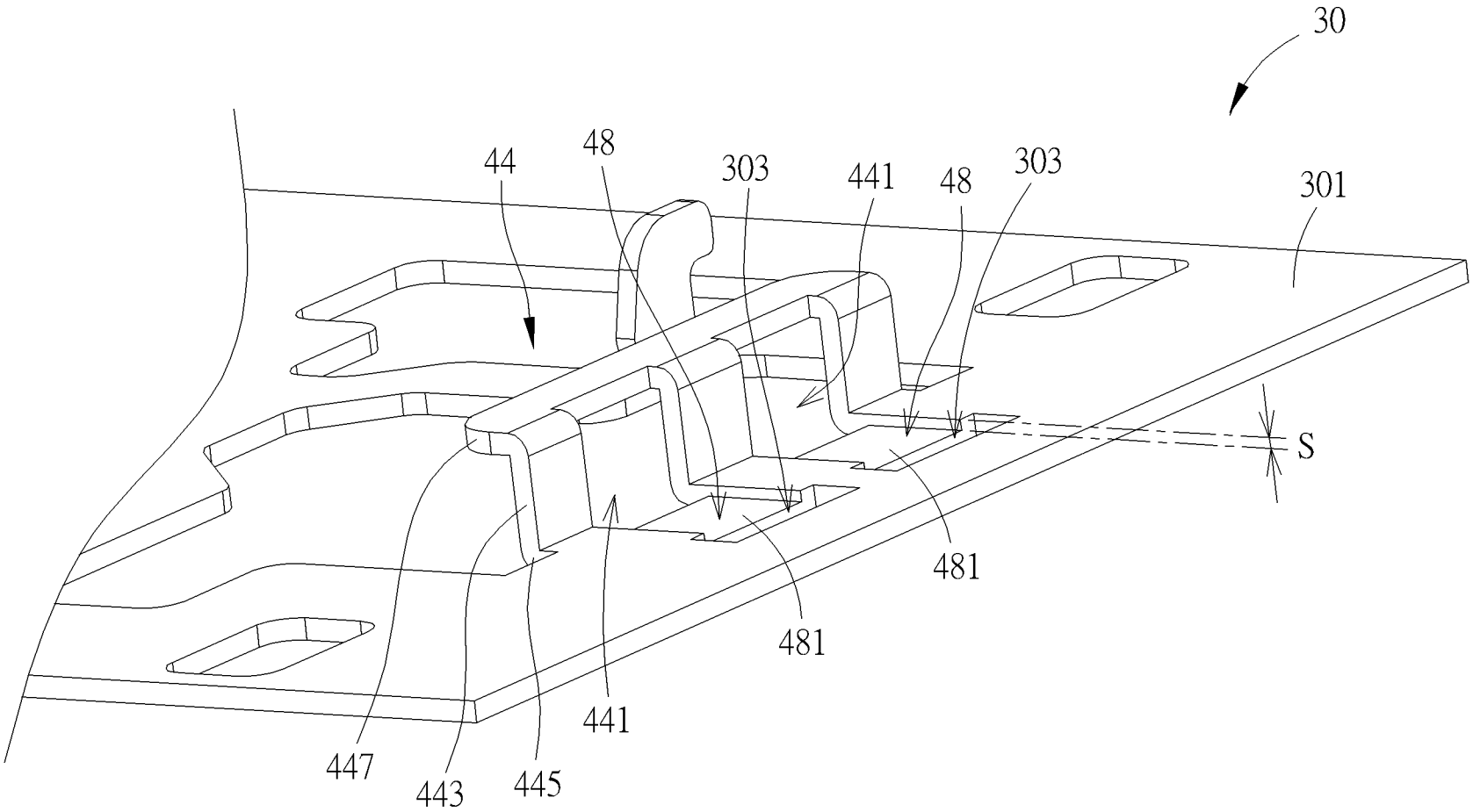
FIG. 7 is a partly diagram of an edge plates and a base according to the embodiment of the present invention.

As shown in FIG. 2 to FIG. 5, the key switch 34 further includes at least one linkage bar 42 and two edge plates 44. The linkage bar 42 connects the key cap 36 and the base 30, and the edge plates 44 are connected to the base 30. Please refer to FIG. 3 to FIG. 7. FIG. 6 is a diagram of the key switch 34 in another view according to the embodiment of the present invention. FIG. 7 is a partly diagram of the edge plates 44 and the base 30 according to the embodiment of the present invention. As shown in FIG. 3 to FIG. 7, at least one slot 441 is formed on the edge plate 44. The key switch 34 further includes a plurality of pivotal structures 46 disposed on the key cap 36. The pivotal structures 46 are used for making the key cap 36 be pivoted to a lateral portion 421 of the linkage bar 42. When the linkage bar 42 is assembled, an end 423 of each of the linkage bars 42 is slidably latched in the slot 441, and the lateral portion 421 of each of the linkage bar 42 is pivoted to the corresponding pivotal structure 46.

In this embodiment, the key switch 34 can include two linkage bars 42, and two slots 441 can be formed on each of the edge plates 44. The lateral portion 421 and the end 423 of each of the linkage bars 42 are respectively installed in the corresponding pivotal structure 46 and the slot 441. Amounts of the linkage bar 42 and the slot 441 on each of the edge plates 44 are not limited to those illustrated in figures in this embodiment. For example, the key switch 34 can include one linkage bar 42 as well, and one slot 441 can be formed on each of the edge plates 44. In other words, structures that the key switch 34 include more than one linkage bar 42 and more than one slot 441 is formed on the edge plate 44 are within the scope of the present invention.

As shown in FIG. 5, when the key cap 36 is pressed, the ends 423 of the two linkage bars 42 are capable of sliding in the slot 441 to approach each other, and the lateral portions 421 of the two linkage bars 42 are capable of pivoting in the corresponding pivotal structure 46. Meanwhile, the key cap 36 is activated by the lateral portions 421 of the two linkage bars 42 to approach the base 30. In addition, when the key switch 34 is pressed, the two linkage bars 42 cooperatively with the lift support mechanism 40 can distribute the pressing force to the key cap 36, such that the key cap 36 moves toward the base 30 more stably for activating the switch 321 of the circuit board 32 and performing the switch instruction.

Similarly, when the key cap 36 is released, the resilient member 38 releases the potential energy to apply the resilient force on the key cap 36, so as to recover the key cap 36. During the process that the key cap 36 recovers, the ends 423 of the two linkage bars 42 are capable of sliding in the slot 441 to depart from each other, and the lateral portions 421 of the two linkage bars 42 are capable of pivoting in the corresponding pivotal structure 46. Meanwhile, the keycap 36 is activated by the lateral portions 421 of the two linkage bars 42 to depart from the base 30. In addition, when the key switch 34 recovers, the two linkage bars 42 cooperatively with the lift support mechanism 40 can evenly distribute the resilient force applied by the resilient member 38 to the key cap 36, such that the key cap 36 moves away from the base 30 more stably. In other words, the linkage bar 42 can be used for driving the key cap 36 to approach or depart from the base 30, so as to stabilize the key cap 36 to lift and descend and thus to facilitate the stability of movement of the key switch 34.

As shown in FIG. 3, FIG. 6 and FIG. 7, the edge plate 44 includes a latching portion 443 and a connecting portion 445. The connecting portion 445 is connected to a side of the latching portion 443 and an edge of the base 30. In this embodiment, the latching portion 443 can be substantially perpendicular to the connecting portion 445, and the slot 441 can be formed on the latching portion 443 and the connecting portion 445. Furthermore, the edge plate 44 further includes an extending portion 447 extending from another side of the latching portion 443. In this embodiment, the extending portion 447 can be substantially perpendicular to the latching portion 443, i.e. the extending portion 447 can be parallel to the connecting portion 445. In practical application, the latching portion 443, the connecting portion 445 and the extending portion 447 can be integrally formed in a stamping mold manner. It should be noticed that the extending portion 447 can be omitted, i.e. the edge plate 44 of the present invention can only include latching portion 443 and connecting portion 445 without extending portion 447 for simplifying manufacturing process of the edge plate 44.

In addition, the key switch 34 further includes a recess portion 48 formed on the base 30 and adjacent to the slot 441 on the latching portion 443 and the connecting portion 445. Furthermore, a step S is formed between a holding surface 481 of the recess portion 48 and a top surface 301 of the base 30, as shown in FIG. 6 and FIG. 7. When the end 423 of the linkage bar 42 is slidably latched in the slot 441 on the latching portion 443 and the connecting portion 445, the end 423 of the linkage bar 42 is caved in the recess portion 48 and held on the holding surface 481 of the recess portion 48. In such a manner, the holding surface 481 of the recess portion 48 and the extending portion 447 of the edge plate 44 are cooperatively used for preventing the end 423 of the linkage bar 42 from turning over, such that the end 423 of the linkage bar 42 stably slides in the slot 441.

Furthermore, since the holding surface 481 of the recess portion 48 and the top surface 301 of the base 30 have the step S therebetween, the linkage bar 42 descends by the step S from the top surface 301 of the base 30 when the end 423 of the linkage bar 42 is caved in the recess portion 48 and held on the holding surface 481 of the recess portion 48. In other words, when the end 423 of the linkage bar 42 is assembled to the edge plate 44, the lateral portion 421 of the linkage bar 42 approaches the base 30 by distance of about the step S since the end 423 of the linkage bar 42 is caved in the recess portion 48 on the base 30. Furthermore, since the lateral portion 421 of the linkage bar 42 is pivoted to the pivotal structure 46 on the key cap 36, the key cap 36 is activated by the lateral portion 421 of the linkage bar 42 to approach the base 30 by the distance of about the step S. In such a manner, overall height of the key switch 34 decreases, and thus it advantages in designs of the key switch 34 and the keyboard 3 toward the trend with thin in size.

In this embodiment, the recess portion 48 can be formed on the base 30 in a stamping mold manner, i.e. the recess portion 48 is a caved structure formed on the base 30 in a stamping mold manner. In practical application, the step S between the holding surface 481 of the recess portion 48 and the top surface 301 of the base 30 is substantially equal to the 0.1 millimeter, but the present invention is not limited thereto. Furthermore, an opening 303 is formed on the base 30 adjacent to the recess portion 48, and the opening 303 and the slot 441 are located on two opposite sides of the recess portion 48. During the process that the base 30 is stamped to form the recess portion 48, the base 30 is stamped to cave and form the recess portion 48, leading lateral protrusion of material of the base 30. Accordingly, the opening 303 is used for providing the base 30 with a space for the material to protrude laterally, such that the recess portion 48 is smoothly formed on the base 30.

Compared to the prior art, the holding portion formed on the base and the step between the holding surface of the holding portion and the top surface of the base of the present invention allow the end of the linkage bar to be caved in the holding portion when the end of the linkage bar is assembled to the edge plate, leading to that the linkage bar approaches the base by the distance of about the step. Furthermore, since the linkage bar is connected to the key cap, the key cap is activated by the linkage bar to approach the base by the distance of about the step. In such a manner, overall height of the key switch decreases, and thus it advantages in designs of the key switch and the keyboard toward the trend with thin in size.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A key switch disposed on a base of a keyboard, comprising:

a key cap disposed above the base;

a linkage bar connecting the key cap and the base;

an edge plate connected to the base, a slot being formed on the edge plate, an end of the linkage bar being slidably latched in the slot; and a recess portion formed on the base and adjacent to the slot, a step being formed between a holding surface of the recess portion and a top surface of the base, the end of the linkage bar being caved in the recess portion and held on the holding surface of the recess portion when the end of the linkage bar is slidably latched in the slot.

2. The key switch of claim 1, wherein the edge plate comprises:

a latching portion; and a connecting portion connected to a side of the latching portion and an edge of the base, wherein the slot is formed on the latching portion and the connecting portion and adjacent to the recess portion.

3. The key switch of claim 2, wherein the latching portion is substantially perpendicular to the connecting portion.

4. The key switch of claim 2, wherein the edge plate further comprises:

an extending portion extending from another side of the latching portion, the extending portion and the recess portion being cooperatively for preventing the end of the linkage bar from turning over.

5. The key switch of claim 4, wherein the extending portion is substantially perpendicular to the latching portion.

6. The key switch of claim 1, wherein an opening is formed on the base and adjacent to the recess portion, and the opening and the slot are located on two opposite sides of the recess portion.

7. The key switch of claim 1, wherein the step is substantially equal to 0.1 millimeter.

8. The key switch of claim 1, further comprising:

a pivotal structure disposed on the key cap, the pivotal structure being for making the key cap be pivoted to a lateral portion of the linkage bar, such that the key cap is activated by the lateral portion of the linkage bar to approach or depart from the base when the end of the linkage bar slides in the slot.

9. The key switch of claim 1, further comprising:

a lift support mechanism disposed between the base and the key cap, the lift support mechanism being for activating the key cap to move toward or away from the base.

10. The key switch of claim 1, wherein the recess portion is formed on the base in a stamping mold manner.

11. A keyboard, comprising:

a base having a top surface; and at least one key switch disposed on the base, comprising:

a key cap disposed above the base;

a linkage bar connecting the key cap and the base;

an edge plate connected to the base, a slot being formed on the edge plate, an end of the linkage bar being slidably latched in the slot; and a recess portion formed on the base and adjacent to the slot, a step being formed between a holding surface of the recess portion and the top surface of the base, the end of the linkage bar being caved in the recess portion and held on the holding surface of the recess portion when the end of the linkage bar is slidably latched in the slot.

12. The keyboard of claim 11, wherein the edge plate comprises:

a latching portion; and a connecting portion connected to a side of the latching portion and an edge of the base, wherein the slot is formed on the latching portion and the connecting portion and adjacent to the recess portion.

13. The keyboard of claim 12, wherein the latching portion is substantially perpendicular to the connecting portion.

14. The keyboard of claim 12, wherein the edge plate further comprises:

an extending portion extending from another side of the latching portion, the extending portion and the recess portion being cooperatively for preventing the end of the linkage bar from turning over.

15. The keyboard of claim 14, wherein the extending portion is substantially perpendicular to the latching portion.

16. The keyboard of claim 11, wherein an opening is formed on the base and adjacent to the recess portion, and the opening and the slot are located on two opposite sides of the recess portion.

17. The keyboard of claim 11, wherein the step is substantially equal to 0.1 millimeter.

18. The keyboard of claim 11, wherein the key switch further comprises:

a pivotal structure disposed on the key cap, the pivotal structure being for making the key cap be pivoted to a lateral portion of the linkage bar, such that the key cap is activated by the lateral portion of the linkage bar to approach or depart from the base when the end of the linkage bar slides in the slot.

19. The keyboard of claim 11, wherein the key switch further comprises:

a lift support mechanism disposed between the base and the key cap, the lift support mechanism being for activating the key cap to move toward or away from the base.

20. The keyboard of claim 11, wherein the recess portion is formed on the base in a stamping mold manner.

* * * * *